US012213551B2

(12) United States Patent
Li et al.

(10) Patent No.: US 12,213,551 B2
(45) Date of Patent: Feb. 4, 2025

(54) MANUFACTURING PROCESS AND APPARATUS FOR DUCKBILL MASK

(71) Applicant: BEIJING BEISHUTE MATERNITY & CHILD ARTICLES CO., LTD, Beijing (CN)

(72) Inventors: Qiuhong Li, Beijing (CN); Donghao Cai, Beijing (CN)

(73) Assignee: BEIJING BEISHUTE MATERNITY & CHILD ARTICLES CO., LTD, Beijing (CN)

( * ) Notice: Subject to any disclaimer, the term of this patent is extended or adjusted under 35 U.S.C. 154(b) by 587 days.

(21) Appl. No.: 17/622,868

(22) PCT Filed: Sep. 18, 2020

(86) PCT No.: PCT/CN2020/116029

§ 371 (c)(1),
(2) Date: Dec. 27, 2021

(87) PCT Pub. No.: WO2022/052149

PCT Pub. Date: Mar. 17, 2022

(65) Prior Publication Data

US 2022/0378134 A1 Dec. 1, 2022

(30) Foreign Application Priority Data

Sep. 14, 2020 (CN) ..... 202010961765.7

(51) Int. Cl.

| | |
|---|---|
| ***A41H 42/00*** | (2006.01) |
| ***A41D 13/11*** | (2006.01) |
| ***A41H 43/02*** | (2006.01) |

(52) U.S. Cl.
CPC ..... *A41H 42/00* (2013.01); *A41D 13/1123* (2013.01); *A41H 43/0235* (2013.01)

(58) Field of Classification Search
CPC . A41D 13/1123; A41H 42/00; A41H 43/0235
(Continued)

(56) References Cited

U.S. PATENT DOCUMENTS

| | | | | |
|---|---|---|---|---|
| 5,701,893 | A | 12/1997 | Kern et al. | |
| 2018/0208426 | A1 * | 7/2018 | Pamperin | B65H 51/30 |

FOREIGN PATENT DOCUMENTS

| | | | |
|---|---|---|---|
| CN | 104188184 | A | 12/2014 |
| CN | 106102494 | A | 11/2016 |

(Continued)

*Primary Examiner* — James D Sells
(74) *Attorney, Agent, or Firm* — Bayramoglu Law Offices LLC

(57) ABSTRACT

A duckbill mask includes a mask upper side and a mask lower side. A manufacturing process includes: respectively performing edge folding and press sealing on an upper nose edge on the mask upper side and a jaw edge on the mask lower side, and using a double-way staggered cutting process to add a nose bridge while folding the upper nose edge; and overlapping the mask upper side and the mask lower side, then performing press sealing on convex edges of the mask upper side and the mask lower side by using a staggered opposite arrangement method, and using a double-way staggered cutting process to add an ear belt while performing press sealing on the convex edges. In the multi-line machining process, multi-line edge folding and press sealing of all layers of materials, overlapping and then finished product cutting are performed, whereby two duckbill masks are manufactured at a time.

15 Claims, 8 Drawing Sheets

(58) Field of Classification Search
USPC ..... 156/201
See application file for complete search history.

(56) References Cited

FOREIGN PATENT DOCUMENTS

| | | | |
|---|---|---|---|
| CN | 106572712 | A | 4/2017 |
| CN | 111227382 | A | 6/2020 |
| CN | 111469464 | A | 7/2020 |
| WO | 2017065792 | A1 | 4/2017 |

* cited by examiner

MANUFACTURING PROCESS AND APPARATUS FOR DUCKBILL MASK

CROSS REFERENCE TO THE RELATED APPLICATIONS

This application is the national phase entry of International Application No. PCT/CN2020/116029, filed on Sep. 18, 2020, which is based upon and claims priority to Chinese Patent Application No. 202010961765.7, filed on Sep. 14, 2020, the entire contents of which are incorporated herein by reference.

TECHNICAL FIELD

The present invention relates to the technical field of rail transit control, in particular to a manufacturing process and apparatus for a duckbill mask.

BACKGROUND

The three-dimensional mask, with a three-dimensional structural design matching the shape of the face, can eliminate gaps between the mask and the side faces of the nose, the cheeks, the jaw, etc., which cannot be eliminated in a common plane mask. The three-dimensional masks mainly comprise duckbill masks, folding masks, cup-shaped masks, etc.

The duckbill mask is used for protecting against extremely small dust particles, is easy to fold and convenient to carry, is provided with a high-filtering-efficiency filtering layer subjected to electrostatic treatment to effectively filter and adsorb tiny harmful dust, and is suitable for various face shapes. The duckbill mask of a ship-shaped design is externally provided with an adjustable nose clamping line, and the elastic band better meets the mechanical requirements, has desirable sealing performance, and can bypass the ears and cross the head so as to avoided discomfort of the ears caused by long-term wearing of the mask, thereby improving the wearing comfort. The three-dimensional design of the duckbill mask makes conversation more convenient, and is particularly suitable for a purification room, preventing bacterial and virus infection for medical treatment, and blocking tiny dust for industry. The inner layer and the outer layer are made of soft PP non-woven fabrics, so as to reduce fiber falling and improve the wearing comfort. The filtering layer is made of a high-efficiency melt-blown material, which may effectively block dust and non-oily particles in air.

The speed of a duckbill mask machine in the prior art is 45-60 pieces/min, and the maximum capacity of the duckbill mask machine is only 60-80 thousand pieces/min every day without stopping, which is low and cannot meet the requirements of government epidemic prevention and resident protection when a large-range epidemic situation suddenly happens. The low mask manufacturing speed is attributed to the fact in a single-line machining process in the prior art, all layers of materials are subjected to the procedures of edge folding, press sealing, overturning, etc. on one conveying line for multiple times, prolonging the mask machining procedure, and causing low capacity of the mask apparatus.

A large amount of material waste is also produced during duckbill mask manufacturing in the prior art. This is because in the existing duckbill mask linear arrangement and single-line machining process, a single duckbill mask is cut in the center of a whole piece of material, and then materials around the mask are all taken as waste materials, which causes great raw material waste.

As shown in FIG. 11, a single-line machining process is used in the prior art, that is, more than ten procedures of sandwiching a melt-blown fabric between two layers of non-woven fabrics, adding a nose bridge, then compounding same, mask piece ring cutting, edge folding, nose edge sealing and pressing, edge folding again, jaw edge sealing and pressing, mask piece folding, side edge sealing and pressing, ear belt adding, convex edge press sealing, finished product cutting, etc, and mask piece folding needs many apparatus actions and consumes many time, causing low capacity of the mask apparatus.

In addition, the masks are arranged in a single line in the prior art as shown in FIG. 12, in the single-line machining process, the mask piece is folded at a folding line (84) and serves as a single duckbill mask cut in the center of a whole piece of material, and then materials around the mask are all taken as waste materials, which causes great raw material waste.

As another example, Chinese invention patent application with publication number CN104188184A provided a one-to-two dust mask machine and a method for manufacturing a mask by using the mask machine: comprising an apparatus platform, a fabric input device used for the apparatus platform, an embossing device used for embossing an input fabric, an initial cutting device used for initially cutting the fabric embossed by the embossing device, a welding device used for welding the ear belt, a bending mechanism used for bending the initially cut fabric, and a fusion cutting device used for carrying out ultrasonic cutting on the bent fabric; and through rational structural arrangement and layout, all automatic production of the dust mask is achieved, the production efficiency is effectively improved, and the produced mask is simple and easy to use. However, in the mask machine, two mask pieces are cut side by side at one time in the center of a whole piece of material, and materials around the masks are taken as waste materials, which causes great raw material waste; and the mask machine is not suitable for manufacturing a duckbill mask.

SUMMARY

For overcoming the above technical defects existing in the prior art and satisfying urgent demands for masks by government epidemic prevention and resident protection in a sudden wide-range epidemic situation, and for solving the problem of low capacity of the duckbill masks in the prior art, a duckbill mask machine in the present invention uses a multi-line machining process, and multi-line edge folding and press sealing of all layers of materials, overlapping and then finished product cutting are performed to produce a duckbill mask.

In order to achieve the above design objective, the present invention uses the following solution:

One aspect of the present invention provides a manufacturing apparatus for a duckbill mask. The manufacturing apparatus includes a compounding mechanism, an edge folding mechanism, an edge sealing mechanism, a convex sealing mechanism and a cutting mechanism, where the compounding mechanism, the edge folding mechanism and the edge sealing mechanism are all multi-line mechanisms; and the edge sealing mechanism includes a nose edge press sealing mechanism and a jaw edge press sealing mechanism, so as to achieve multi-line machining and improve work efficiency. The multi-line mechanism is a mechanism in which two production lines work simultaneously; the nose edge press sealing mechanism is a mechanism for pressing and forming an added nose bridge after edge folding; and the jaw edge press sealing mechanism is a mechanism for pressing and forming a jaw edge.

Preferably, the compounding mechanism includes a mask upper-side compounding component and a mask lower-side compounding component, wherein the mask upper-side compounding component and the mask lower-side compounding component work simultaneously, the mask upper-side compounding component is provided with a mask upper-side outer non-woven fabric roll, a mask upper-side melt-blown fabric roll, a mask upper-side inner non-woven fabric roll and a mask upper-side compounding wheel, such that compounding of materials of a mask upper side is completed at the mask upper-side compounding wheel; and the mask lower-side compounding component is provided with a mask lower-side outer non-woven fabric roll, a mask lower-side melt-blown fabric roll, a mask lower-side inner non-woven fabric roll and a mask lower-side compounding wheel, such that compounding of materials of a mask lower side is completed at the mask lower-side compounding wheel.

Preferably, in any solution, the edge folding mechanism includes a left mask nose bridge strip, a right mask nose bridge strip, a nose bridge cutter roller, a nose bridge chisel roller, a nose bridge left cutter wheel, a nose bridge right cutter wheel, a left mask nose bridge, a right mask nose bridge, a mask lower-side right edge folding component and a mask lower-side left edge folding component.

Preferably, in any solution, the nose bridge left cutter wheel and the nose bridge right cutter wheel are mounted at two ends of the nose bridge cutter roller separately.

A working process of the edge folding mechanism is as follows: when the left mask nose bridge strip and the right mask nose bridge strip pass through a gap between the nose bridge cutter roller and the nose bridge chisel roller, the left mask nose bridge strip and the right mask nose bridge strip are sequentially cut into a left mask nose bridge and a right mask nose bridge by the nose bridge left cutter wheel and the nose bridge right cutter wheel, and then are wrapped in a folded edge by a mask upper-side left edge folding apparatus and a mask upper-side right edge folding apparatus respectively, and the edge-folded compounding material, that is, a mask upper-side outer non-woven fabric, a mask upper-side melt-blown fabric and a mask upper-side inner non-woven fabric, is called as the mask upper side; and a mask lower-side outer non-woven fabric, a mask lower-side melt-blown fabric and a mask lower-side inner non-woven fabric are compounded, then the mask lower-side right edge folding component and the mask lower-side left edge folding component complete edge folding, and the edge-folded mask is called as the mask lower side.

Preferably, in any solution, an outer surface of the nose bridge left cutter wheel is provided with a nose bridge left front cutter and a nose bridge left rear cutter; and an outer surface of the nose bridge right cutter wheel is provided with a nose bridge right front cutter and a nose bridge right rear cutter.

Preferably, in any solution, the nose bridge left front cutter, the nose bridge left rear cutter, the nose bridge right front cutter and the nose bridge right rear cutter bisect a circumference, such that the cutters at two ends do not cut simultaneously, but cut sequentially left and right.

When the nose bridge chisel roller and the nose bridge cutter roller rotate, the nose bridge left front cutter and the nose bridge left rear cutter as well as the nose bridge right front cutter and the nose bridge right rear cutter cut respectively and sequentially left and right, so as to cut the left mask nose bridge and the right mask nose bridge.

Preferably, in any solution, the edge sealing mechanism includes a mask upper edge sealing component and a mask lower edge sealing component, where the mask upper edge sealing component includes a mask upper-side guide wheel, a mask upper-side edge sealing upper roller, a mask upper-side edge sealing lower roller and a nose bridge press sealing edge; and the mask lower edge sealing component includes a mask lower-side edge sealing upper roller, a mask lower-side edge sealing lower roller, a jaw press sealing edge and a mask lower-side guide wheel.

A working process of the edge sealing mechanism is as follows: the mask upper side passes through a gap between the mask upper-side edge sealing upper roller and the mask upper-side edge sealing lower roller to press and seal a nose bridge edge, and then is continuously conveyed by the mask upper-side guide wheel, and a mask body at the position is called as the edge-sealed mask upper side; and the mask lower side passes through a gap between the mask lower-side edge sealing upper roller and a mask lower-side edge sealing lower roller to press and seal a jaw edge, and then is continuously conveyed by the mask lower-side guide wheel, and a mask body at the position is called as the edge-sealed mask lower side.

Preferably, in any solution, a mask upper-side left edge sealing member and a mask upper-side right edge sealing member are arranged at two ends of the mask upper-side edge sealing upper roller separately, and a left mask nose bridge position is arranged on the mask upper-side left edge sealing member; and a right mask nose bridge position is arranged on the mask upper-side right edge sealing member, and the left mask nose bridge position and the right mask nose bridge position are staggered.

Preferably, in any solution, the convex sealing mechanism is provided with a first right mask ear belt roll, a first left mask ear belt roll, a front slow release wheel, a rear slow release wheel, a right ear belt cutter wheel, a left ear belt cutter wheel, an ear belt chisel, a second right mask ear belt roll, a second left mask ear belt roll, an upper overlapping roller, a lower overlapping roller, a convex-edge press sealing upper roller and a convex-edge press sealing lower roller.

A working process of the convex sealing mechanism is as follows: the first right mask ear belt roll and the first left mask ear belt roll are slowly released by the front slow release wheel and the rear slow release wheel, then sequentially cut into a second right mask ear belt and a second left mask ear belt when passing through gaps between the right ear belt cutter wheel, the left ear belt cutter wheel and the ear belt chisel, and placed on a surface of the edge-sealed mask upper side guided by the guide wheel, then the edge-sealed mask lower side and the edge-sealed mask upper side are overlapped, and the overlapped edge-sealed mask lower side and edge-sealed mask upper side are pressed into a whole by the upper overlapping roller and the lower overlapping roller to be called as an overlapped mask. When the overlapped mask passes through a gap between the convex-edge press sealing upper roller and the convex-edge press sealing lower roller, convex-edge press sealing of the duckbill mask are completed, and the convex-sealed mask is called as a convex-press-sealed mask.

Preferably, in any solution, the first right mask ear belt roll and the first left mask ear belt roll are mounted on the front slow release wheel and the rear slow release wheel, when a material wheel rotates, the material wheel and the double slow release wheels have friction force, and the material wheel making contact with outer circle faces of the double slow release wheels has relative resistance during rotation, such that a material on the material wheel may be slowly released.

Preferably, in any solution, the cutting mechanism includes a finished product cutting chisel and an upper cutting roller.

A working process of the cutting mechanism is as follows: when the convex-press-sealed mask passes through a gap between the finished product cutting chisel and the finished product upper cutting roller, a finished product cutter on an outer surface of the finished product upper cutting roller cuts off the overlapped mask upper side and mask lower side to form a single duckbill mask piece, so as to complete manufacturing of the duckbill mask.

Preferably, in any solution, the manufacturing apparatus for a duckbill mask is further provided with a double slow-release wheel pressing mechanism, where the double slow-release wheel pressing mechanism includes a first slow release wheel or a second slow release wheel fixedly connected to one end of a slow release wheel shaft and a left friction wheel integrally connected to the other end of the slow release wheel shaft; and the other end of the left friction wheel matches a right friction wheel fixed on a fixing shaft, and the right friction wheel slides along an axis of the fixing shaft.

Preferably, in any solution, a right support bearing and a left support bearing are arranged on two sides of a connection of the first slow release wheel or the second slow release wheel to the slow release wheel shaft.

Preferably, in any solution, the right friction wheel makes close contact with one end of a compression spring, the other end of the compression spring abuts against a compression nut, and the compression nut is connected to a threaded end of the fixing shaft; and when the first slow release wheel or the second slow release wheel rotates, the left friction wheel is driven by the slow release wheel shaft to rotate.

A double slow-release wheel machining process is as follows: when the first slow release wheel or the second slow release wheel rotates, the left friction wheel is driven by the slow release wheel shaft to rotate, in such a condition, the right friction wheel is fixed, in addition, the compression spring is compressed by the compression nut, then the compression spring generates pre-tightening pressure, the pre-tightening pressure is transmitted to the right friction wheel, and then pre-friction force of the two friction wheels is formed. When the left friction wheel rotates, the pre-friction force generates resistance to reduce a speed of the left friction wheel, and meanwhile, a speed of the first slow release wheel or the second slow release wheel is reduced during rotation. When the speed of the first slow release wheel or the second slow release wheel needs to be reduced during rotation, the compression spring may be further compressed, so as to increase the pre-tightening pressure; and when the speed of the first slow release wheel or the second slow release wheel needs to be increased during rotation, the pressure on the compression spring may be released, so as to reduce the pre-tightening pressure, and therefore, the purpose of adjusting friction force between the double slow release wheels and a material wheel is achieved.

The other aspect of the present invention provides a manufacturing process for a duckbill mask. The manufacturing process uses a multi-line machining process, a staggered opposite arrangement method, a double-way staggered cutting process and a double slow-release wheel machining process.

The manufacturing process for a duckbill mask includes a multi-line mask machining apparatus, and includes:

firstly, sandwiching a melt-blown fabric between two layers of non-woven fabrics for compounding, and then respectively performing edge folding and press sealing on an upper nose edge on a mask upper side and a jaw edge on a mask lower side;

secondly, using a double-way staggered cutting process to add a nose bridge while folding the upper nose edge;

thirdly, overlapping the mask upper side and the mask lower side, then using a staggered opposite arrangement method to perform press sealing on convex edges of the mask upper side and the mask lower side, and using a double-way staggered cutting process to add an ear belt while performing press sealing on the convex edges; and fourthly, cutting and overlapping a finished product, then taking the mask upper side and the mask lower side as single masks.

In summary, the manufacturing process and apparatus for a duckbill mask in the present invention have the following advantages:

By using the staggered opposite arrangement method, a spacing distance of the masks is shortened, a utilization rate of bottom edge materials is high, and less waste materials are cut around the masks.

The present invention applies a double-way staggered cutting technology to the multi-line machining process, since the staggered opposite arrangement method is used in the multi-line machining process, masks on two sides in the mask manufacturing process are staggered, and therefore, the double-way staggered cutting technology may finish cutting of a nose bridge and an ear belt in a staggered mode on one device and add same into the mask; and compared with a single-line machining process, a process flow is shortened, and time-consuming processes of mask piece folding, etc. are reduced, thereby improving the capacity of the apparatus per unit time.

A double slow-release wheel technology is used in the present invention, needs no power source, is suitable for materials with high material softness, has a simple structure, and saves energy.

Through production on-site measurement in the epidemic period, the capacity of a duckbill mask machine using the process and apparatus in the present invention is 300-400 pieces per minute, which completely meets a large-scale requirement of society for masks in the epidemic period.

The duckbill mask body may be made of multi-layer non-woven fabrics and filtering materials (for example, melt-blown fabrics, etc.), so as to produce finished masks reaching various filtering levels of N95, FFP2, etc., and further to achieve industrial production and manufacturing.

The present invention uses the multi-line machining process, the staggered opposite arrangement method, the double-way staggered cutting technology and the double slow-release wheel technology, thereby completing automatic production of the duckbill mask, simplifying the process and apparatus, meeting the large-scale requirements of society for the masks in the epidemic period, and exhibiting practicability.

DETAILED DESCRIPTION OF THE EMBODIMENTS

In order to more clearly illustrate the embodiments of the present invention or the technical solutions in the prior art, a brief introduction to the accompanying drawings required for the description of the embodiments or the prior art will be provided below. Apparently, the accompanying drawings in the following description show merely some embodiments of the present invention, and other embodiments can be derived from these accompanying drawings by those of ordinary skill in the art without creative efforts.

Figure 1:
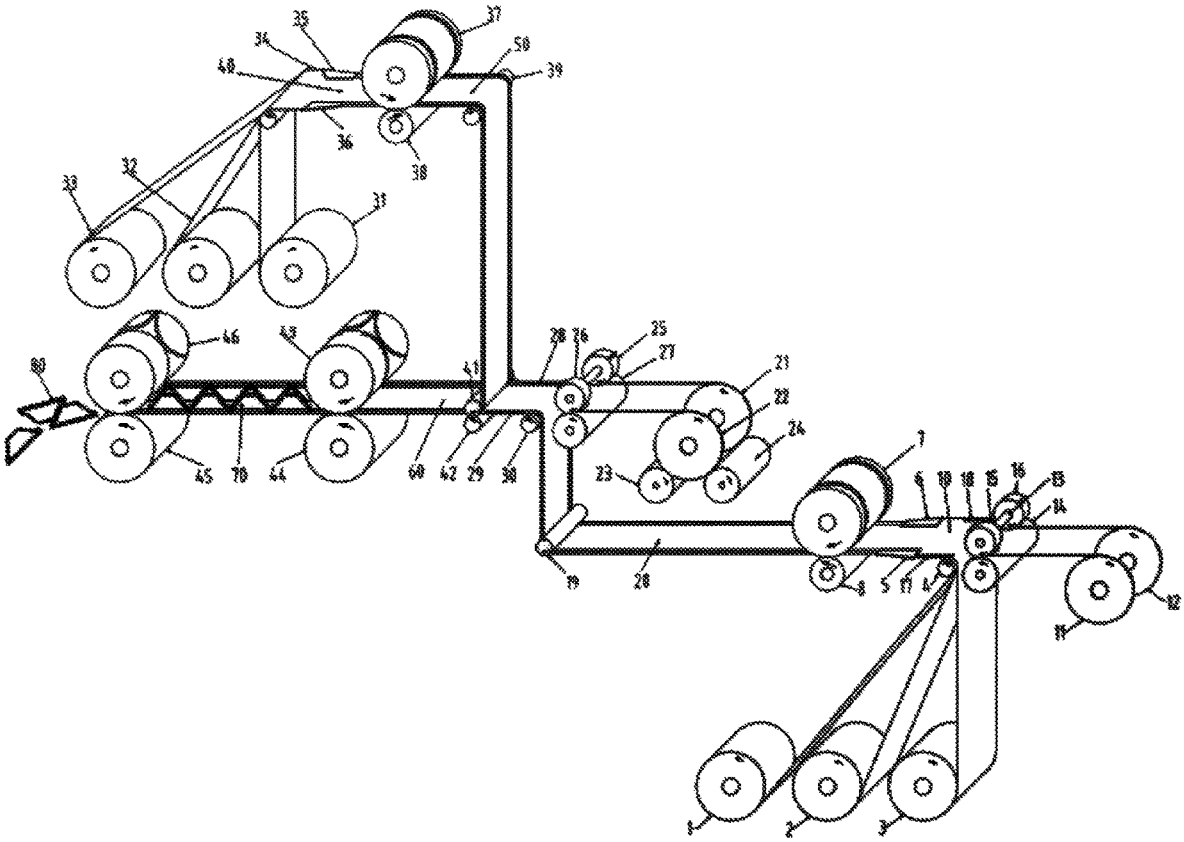
FIG. 1 is a diagram of a manufacturing process for a duckbill mask according to the present invention.

FIG. 1 is a diagram of a manufacturing process for a duckbill mask according to the present invention. The present invention provides a manufacturing process and apparatus for a duckbill mask, including:

One aspect of the present invention provides a manufacturing apparatus for a duckbill mask. The manufacturing apparatus includes a compounding mechanism, an edge folding mechanism, an edge sealing mechanism, a convex sealing mechanism and a cutting mechanism, where the compounding mechanism, the edge folding mechanism and the edge sealing mechanism are all multi-line mechanisms; and the edge sealing mechanism includes a nose edge press sealing mechanism and a jaw edge press sealing mechanism.

In this embodiment, the compounding mechanism includes a mask upper-side compounding component and a mask lower-side compounding component, wherein the mask upper-side compounding component and the mask lower-side compounding component work simultaneously, the mask upper-side compounding component is provided with a mask upper-side outer non-woven fabric roll 1, a mask upper-side melt-blown fabric roll 2, a mask upper-side inner non-woven fabric roll 3 and a mask upper-side compounding wheel 4, such that compounding of materials of a mask upper side 10 is completed at the mask upper-side compounding wheel 4; and the mask lower-side compounding component is provided with a mask lower-side outer non-woven fabric roll 31, a mask lower-side melt-blown fabric roll 32, a mask lower-side inner non-woven fabric roll 33 and a mask lower-side compounding wheel 34, such that compounding of materials of a mask lower side 40 is completed at the mask lower-side compounding wheel 34.

In this embodiment, the edge folding mechanism includes a left mask nose bridge strip 11, a right mask nose bridge strip 12, a nose bridge cutter roller 13, a nose bridge chisel roller 14, a nose bridge left cutter wheel 15, a nose bridge right cutter wheel 16, a left mask nose bridge 17, a right mask nose bridge 18, a mask lower-side right edge folding component 35 and a mask lower-side left edge folding component 36.

In this embodiment, the nose bridge left cutter wheel 15 and the nose bridge right cutter wheel 16 are arranged at two ends of the nose bridge cutter roller 13 separately.

A working process of the edge folding mechanism is as follows: when the left mask nose bridge strip 11 and the right mask nose bridge strip 12 pass through a gap between the nose bridge cutter roller 13 and the nose bridge chisel roller 14, the left mask nose bridge strip 11 and the right mask nose bridge strip 12 are sequentially cut into a left mask nose bridge 17 and a right mask nose bridge 18 by the nose bridge left cutter wheel 15 and the nose bridge right cutter wheel 16, and then are wrapped in a folded edge by a mask upper-side left edge folding apparatus 5 and a mask upper-side right edge folding apparatus 6 respectively, and the edge-folded compounding material, that is, a mask upper-side outer non-woven fabric 1, a mask upper-side melt-blown fabric 2 and a mask upper-side inner non-woven fabric 3, is called as the mask upper side 10; and a mask lower-side outer non-woven fabric 31, a mask lower-side melt-blown fabric 32 and a mask lower-side inner non-woven fabric 33 are compounded, then the mask lower-side right edge folding component 35 and the mask lower-side left edge folding component 36 complete edge folding, and the edge-folded mask is called as the mask lower side 40.

Figure 5:
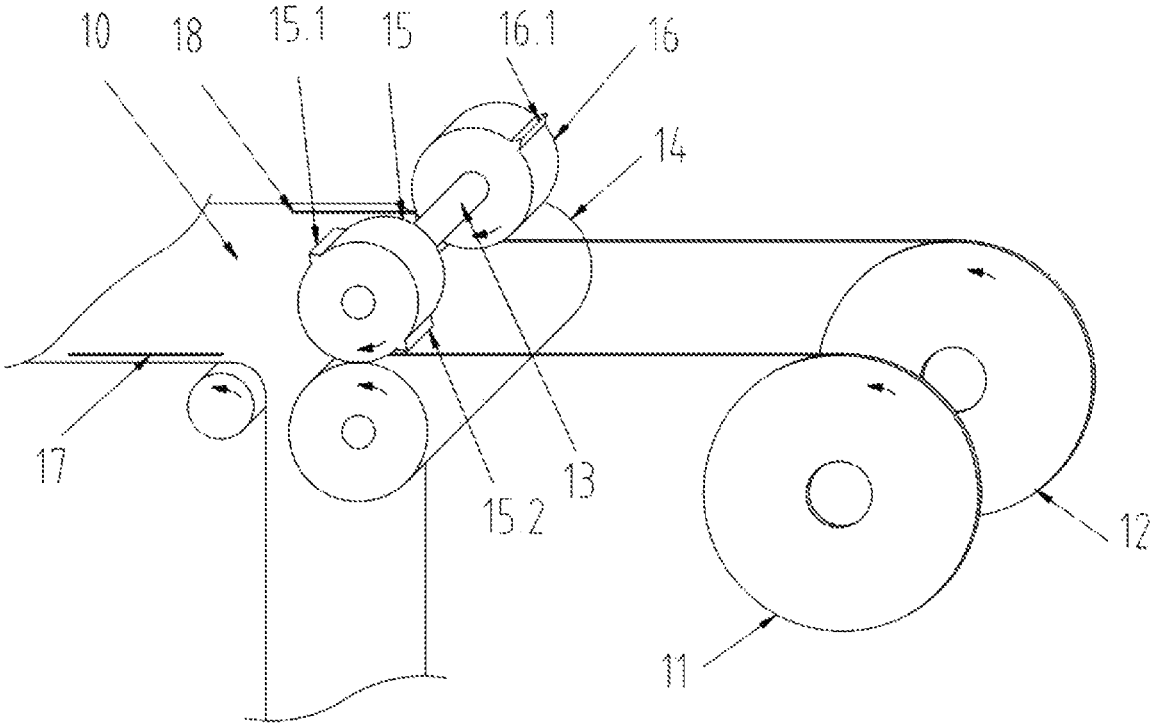
FIG. 5 is a schematic diagram of a mask two-way staggered cutting process of the preferred embodiment shown in FIG. 1 of the manufacturing process for a duckbill mask according to the present invention.

FIG. 5 is a schematic diagram of a mask two-way staggered cutting process of the preferred embodiment shown in FIG. 1 of the manufacturing process for a duckbill mask according to the present invention.

In this embodiment, an outer surface of the nose bridge left cutter wheel 15 is provided with a nose bridge left front cutter 15.1 and a nose bridge left rear cutter 15.2; and an outer surface of the nose bridge right cutter wheel 16 is provided with a nose bridge right front cutter 16.1 and a nose bridge right rear cutter (as shown in FIG. 5).

In this embodiment, the nose bridge left front cutter 15.1, the nose bridge left rear cutter 15.2, the nose bridge right front cutter 16.1 and the nose bridge right rear cutter bisect a circumference (as shown in FIG. 5), such that the cutters at two ends do not cut simultaneously, but cut sequentially left and right.

The nose bridge left front cutter 15.1, the nose bridge left rear cutter 15.2, the nose bridge right front cutter 16.1 and the nose bridge right rear cutter are uniformly distributed on the circumference. For example, under the condition that the apparatus is provided with four cutters at two ends, an included angle between every two cutters is 90 degrees, and the included angles of the four cutters are 360 degrees; and under the condition that the apparatus is provided with six cutters at two ends, an included angle between every two cutters is 60 degrees, the included angles of the six cutters are 360 degrees, and so on.

When the nose bridge chisel roller 14 and the nose bridge cutter roller 13 rotate, the nose bridge left front cutter 15.1 and the nose bridge left rear cutter 15.2 as well as the nose bridge right front cutter 16.1 and the nose bridge right rear cutter cut respectively and sequentially left and right, so as to cut the left mask nose bridge 17 and the right mask nose bridge 18.

In this embodiment, the mask upper-side compounding wheel 4 guides the mask upper side 10 slightly below a level of the nose bridge. The left mask nose bridge strip 11 and the right mask nose bridge strip 12 are pulled by traction force generated when the nose bridge chisel roller 14 and the nose bridge cutter roller 13 rotate, and move from a right side to a left side in the figure.

Mask double-way staggered cutting process engineering is as follows: cutter wheels are mounted at two ends of the nose bridge and ear belt cutter rollers separately, cutters are mounted on the cutter wheels at the two ends, the cutters at the two ends are evenly distributed on the circumference, and therefore, the cutters at the two ends do not cut simultaneously but cut sequentially left and right.

In this embodiment, the edge sealing mechanism includes a mask upper edge sealing component and a mask lower edge sealing component, where the mask upper edge sealing component includes a mask upper-side guide wheel 19, a mask upper-side edge sealing upper roller 7, a mask upper-side edge sealing lower roller 8 and a nose bridge press sealing edge 81; and the mask lower edge sealing component includes a mask lower-side edge sealing upper roller 37, a mask lower-side edge sealing lower roller 38, a jaw press sealing edge 82 and a mask lower-side guide wheel 39.

Figure 2:
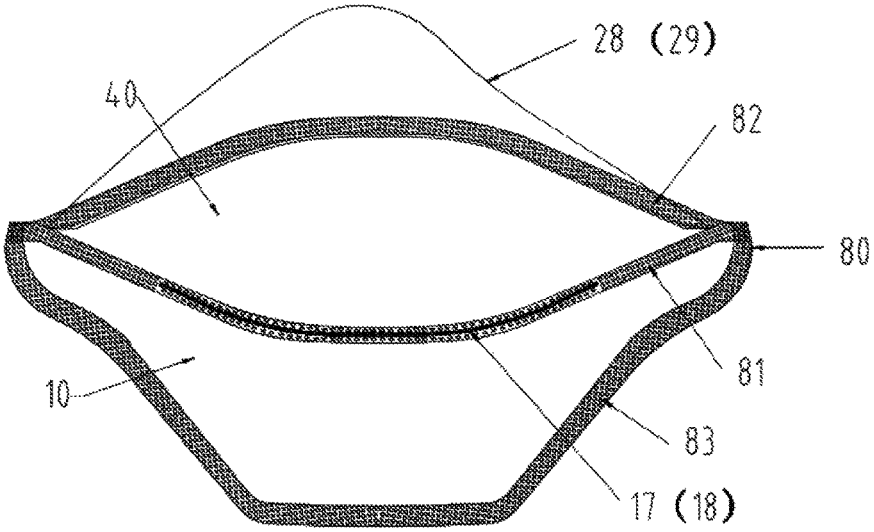
FIG. 2 is a structural schematic diagram of a mask made by the manufacturing process for a duckbill mask according to the present invention.

A working process of the edge sealing mechanism is as follows: the mask upper side 10 passes through a gap between the mask upper-side edge sealing upper roller 7 and the mask upper-side edge sealing lower roller 8 to press and seal a nose bridge edge 81 (as shown in FIG. 2), and then is continuously conveyed by the mask upper-side guide wheel 19, and a mask body at the position is called as the edge-sealed mask upper side 20; and the mask lower side 40 passes through a gap between the mask lower-side edge sealing upper roller 37 and a mask lower-side edge sealing lower roller 38 to press and seal a jaw edge 82 (as shown in FIG. 2), and then is continuously conveyed by the mask lower-side guide wheel 39, and a mask body at the position is called as the edge-sealed mask lower side 50.

Figure 4:
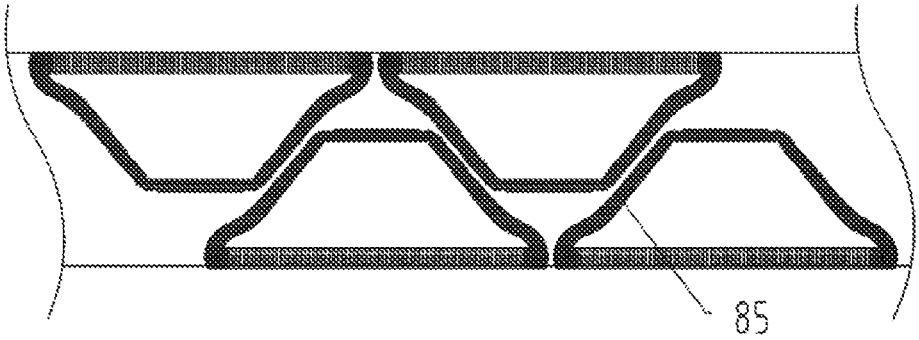
FIG. 4 is a schematic diagram of the mask staggered opposite arrangement of the preferred embodiment shown in FIG. 1 of the manufacturing process for a duckbill mask according to the present invention.

FIG. 4 is a schematic diagram of the mask staggered opposite arrangement of the preferred embodiment shown in FIG. 1 of the manufacturing process for a duckbill mask according to the present invention.

A relatively inverted duckbill mask is distributed between two side-by-side duckbill masks, a top of a convex edge of the inverted duckbill mask and waistlines 85 of the two duckbill masks are on an identical horizontal line, and are sequentially arranged. A spacing distance of the masks is shortened, a utilization rate of bottom edge materials is high, and less waste materials are cut around the masks.

FIG. 2 is a structural schematic diagram of a mask made by the manufacturing process for a duckbill mask according to the present invention.

A single duckbill mask piece 80 consists of a mask upper side 10 and a mask lower side 40, a first mask ear belt roll 28 and a second mask ear belt roll 29 are arranged between the mask upper side 10 and the mask lower side 40, a left mask nose bridge 17 and a right mask nose bridge 18 are embedded in the mask upper side 10, and the left mask nose bridge 17 and the right mask nose bridge 18 are embedded in a mask upper-side edge seal 81; and the left mask nose bridge 17 and the right mask nose bridge 18 are not embedded in a mask lower-side edge seal 82, and a mask convex seal 83 is formed after the mask upper side 10 and the mask lower side 40 are overlapped.

Figure 6:
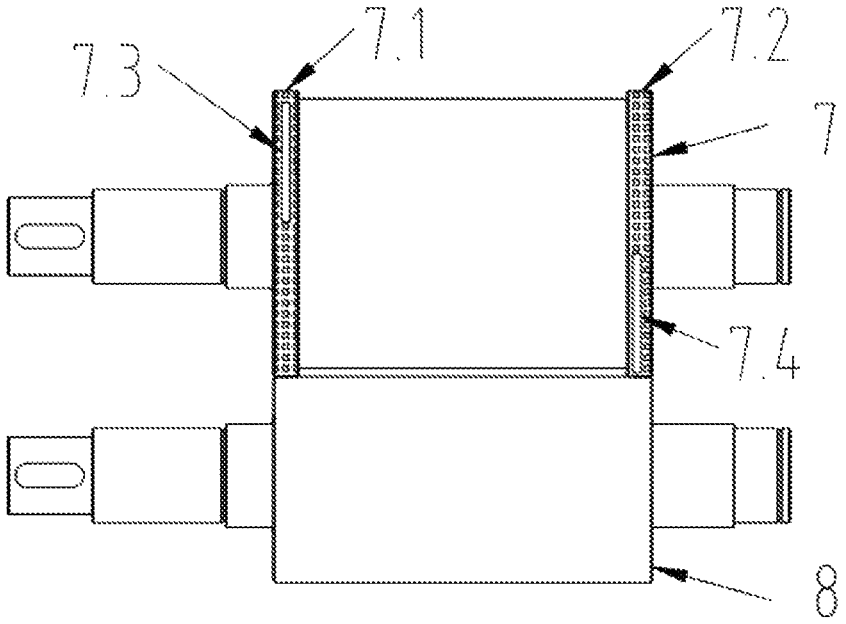
FIG. 6 is a structural schematic diagram of an edge sealing apparatus of the preferred embodiment shown in FIG. 1 of the manufacturing process for a duckbill mask according to the present invention.

FIG. 6 is a structural schematic diagram of an edge sealing apparatus of the preferred embodiment shown in FIG. 1 of the manufacturing process for a duckbill mask according to the present invention.

In this embodiment, a mask upper-side left edge sealing member 7.1 and a mask upper-side right edge sealing member 7.2 are arranged at two ends of the mask upper-side edge sealing upper roller 7 separately, and a left mask nose bridge position 7.3 is arranged on the mask upper-side left edge sealing member 7.1; and a right mask nose bridge position 7.4 is arranged on the mask upper-side right edge sealing member 7.2, and the left mask nose bridge position 7.3 and the right mask nose bridge position 7.4 are staggered.

In this embodiment, the convex sealing mechanism is provided with a first right mask ear belt roll 21, a first left mask ear belt roll 22, a front slow release wheel 23, a rear slow release wheel 24, a right ear belt cutter wheel 25, a left ear belt cutter wheel 26, an ear belt chisel 27, a second right mask ear belt roll 28, a second left mask ear belt roll 29, an upper overlapping roller 41, a lower overlapping roller 42, a convex-edge press sealing upper roller 43 and a convex-edge press sealing lower roller 44.

Figure 7:
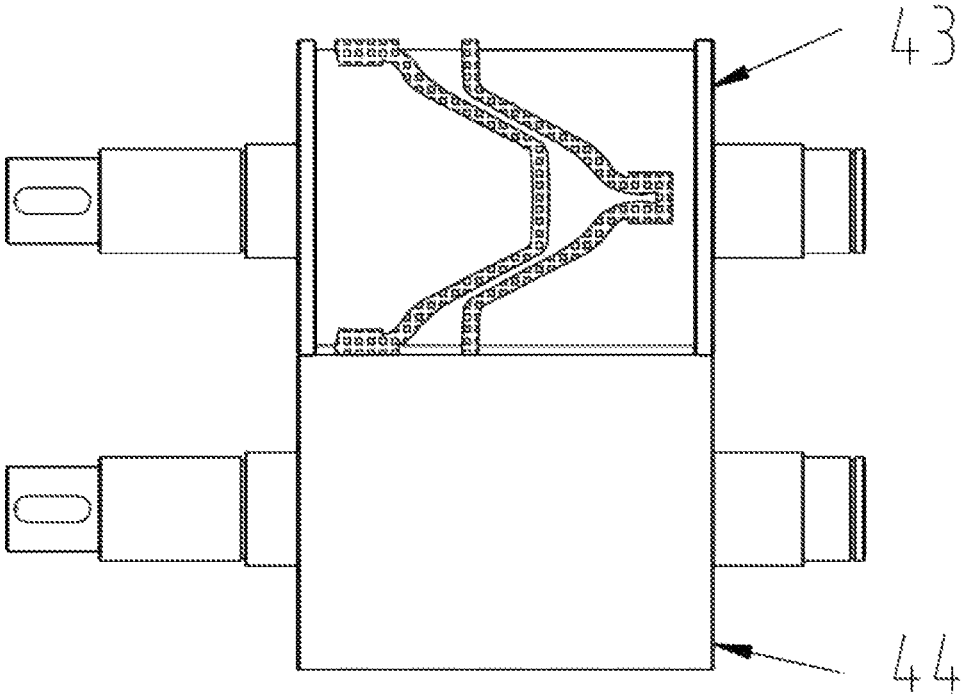
FIG. 7 is a structural schematic diagram of a periphery sealing apparatus of the preferred embodiment shown in FIG. 1 of the manufacturing process for a duckbill mask according to the present invention.

A working process of the convex sealing mechanism is as follows: the first right mask ear belt roll 21 and the first left mask ear belt roll 22 are slowly released by the front slow release wheel 23 and the rear slow release wheel 24, then sequentially cut into a second right mask ear belt 28 and a second left mask ear belt 29 when passing through gaps between the right ear belt cutter wheel 25, the left ear belt cutter wheel 26 and the ear belt chisel 27, and placed on a surface of the edge-sealed mask upper side 20 guided by the guide wheel 30, then the edge-sealed mask lower side 50 and the edge-sealed mask upper side 20 are overlapped, and the overlapped edge-sealed mask lower side 50 and edge-sealed mask upper side 20 are pressed into a whole by the upper overlapping roller 41 and the lower overlapping roller 42 to be called as an overlapped mask 60. When the overlapped mask 60 passes through a gap between the convex-edge press sealing upper roller 43 and the convex-edge press sealing lower roller 44 (as shown in FIG. 7), convex-edge press sealing of the duckbill mask are completed, and the convex-sealed mask is called as a convex-press-sealed mask 70.

In this embodiment, the first right mask ear belt roll 21 and the first left mask ear belt roll 22 are mounted on the front slow release wheel 23 and the rear slow release wheel 24, when a material wheel rotates, the material wheel and the double slow release wheels have friction force, and the material wheel making contact with outer circle faces of the double slow release wheels has relative resistance during rotation, such that a material on the material wheel may be slowly released.

Figure 8:
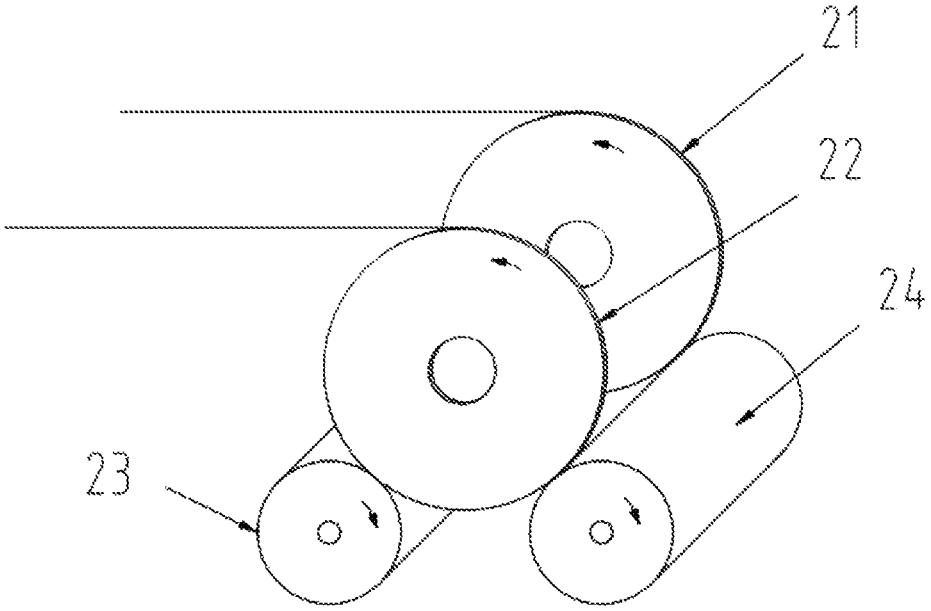
FIG. 8 is a structural schematic diagram of double slow release wheels of the preferred embodiment shown in FIG. 1 of the manufacturing process for a duckbill mask according to the present invention.

FIG. 8 is a structural schematic diagram of double slow release wheels of the preferred embodiment shown in FIG. 1 of the manufacturing process for a duckbill mask according to the present invention.

In this embodiment, the manufacturing apparatus for a duckbill mask is further provided with a double slow-release wheel pressing mechanism, where the double slow-release wheel pressing mechanism includes a first slow release wheel 23 or a second slow release wheel 24 fixedly connected to one end of a slow release wheel shaft 91 and a left friction wheel 94 integrally connected to the other end of the slow release wheel shaft 91; and the other end of the left friction wheel 94 matches a right friction wheel 95 fixed on a fixing shaft 98, and the right friction wheel 95 slides along an axis of the fixing shaft 98.

In this embodiment, a right support bearing 92 and a left support bearing 93 are arranged on two sides of a connection of the first slow release wheel 23 or the second slow release wheel 24 to the slow release wheel shaft 91.

In this embodiment, the right friction wheel 95 makes close contact with one end of a compression spring 96, the other end of the compression spring 96 abuts against a compression nut 97, and the compression nut 97 is connected to a threaded end of the fixing shaft 98; and when the first slow release wheel 23 or the second slow release wheel 24 rotates, the left friction wheel 94 is driven by the slow release wheel shaft 91 to rotate.

In this embodiment, the two friction wheels are additionally arranged on the double slow release wheels, one friction wheel rotates along with one slow release wheel, the other slow release wheel is fixed, the spring is arranged at one end of the fixed friction wheel, and the nut is arranged behind the spring. The pre-tightening pressure is given to the spring by means of the nut, the pressure is transmitted to one end of the friction wheel to form pre-friction force of the two friction wheels, and the friction force between the double slow release wheels and the material wheel may be increased by increasing the pre-friction force. Otherwise, the friction force between the double slow release wheels and the material wheel may be reduced by reducing the pre-friction force, such that the purpose of adjusting the friction force between the double slow release wheels and the material wheel is achieved.

Figure 9:
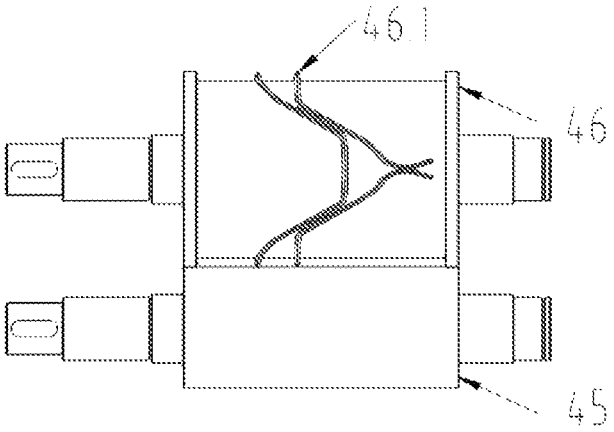
FIG. 9 is a schematic diagram of finished product cutting of the preferred embodiment shown in FIG. 1 of the manufacturing process for a duckbill mask according to the present invention.

FIG. 9 is a schematic diagram of finished product cutting of the preferred embodiment shown in FIG. 1 of the manufacturing process for a duckbill mask according to the present invention.

In this embodiment, the cutting mechanism includes a finished product cutting chisel 45 and an upper cutting roller 46.

A working process of the cutting mechanism is as follows: when the convex-press-sealed mask 70 passes through a gap between the finished product cutting chisel 45 and the finished product upper cutting roller 46, a finished product cutter 46.1 on an outer surface of the finished product upper cutting roller 46 cuts off the overlapped mask upper side and mask lower side to form a single duckbill mask piece 80, so as to complete manufacturing of the duckbill mask.

Figure 10:
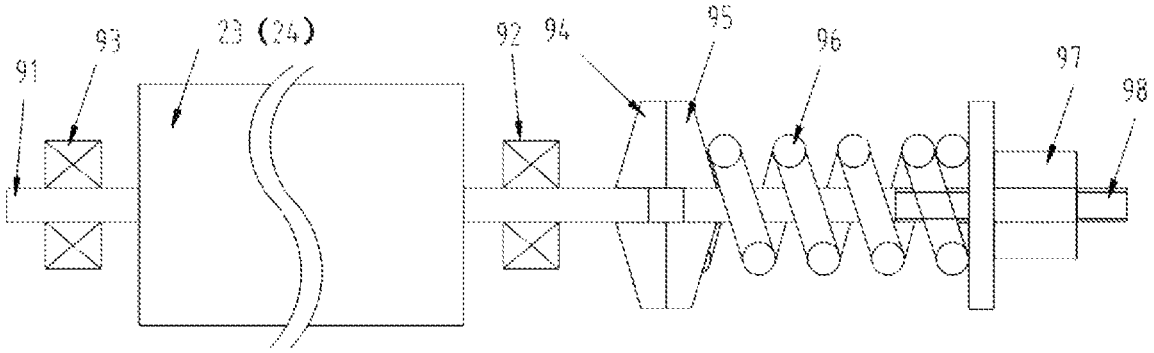
FIG. 10 is a structural schematic diagram of a friction adjustment mechanism of the double slow release wheels of the preferred embodiment shown in FIG. 1 of the manufacturing process for a duckbill mask according to the present invention.
Figure 11:
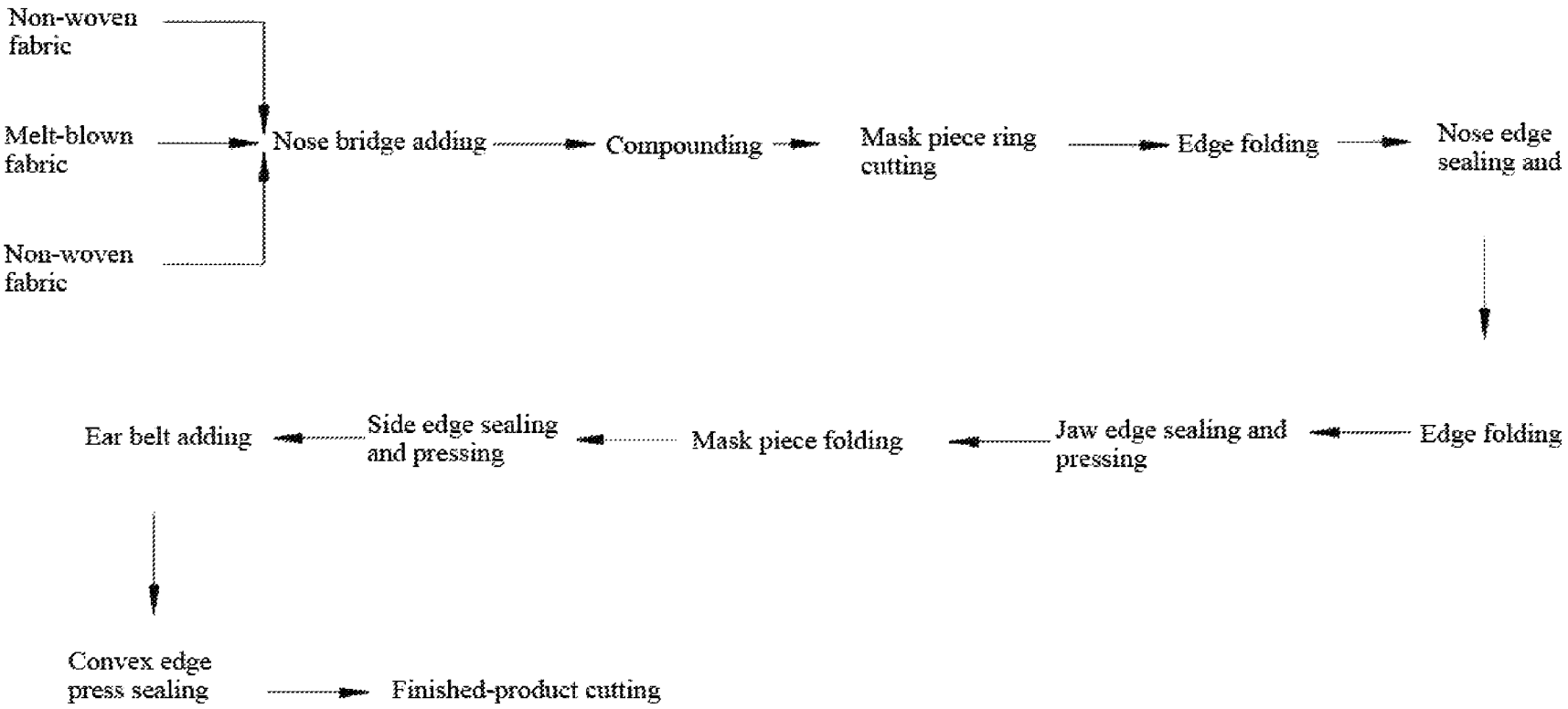
FIG. 11 is a flow chart of a single-line machining process of a mask in the prior art.
Figure 12:
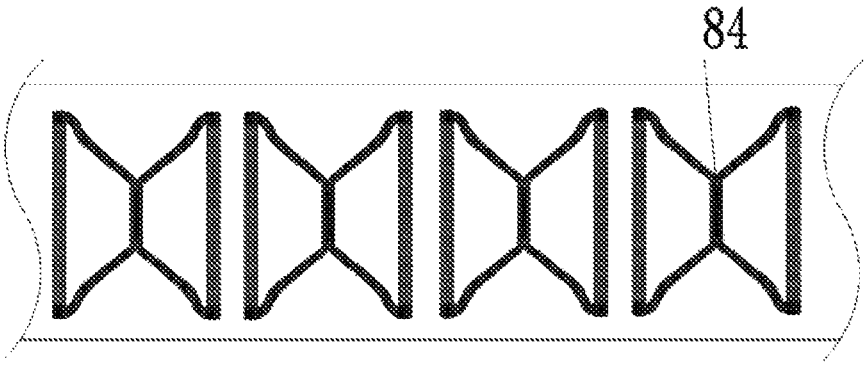
FIG. 12 is a schematic diagram of butterfly arrangement of masks in the prior art.

FIG. 10 is a structural schematic diagram of a friction adjustment mechanism of the double slow release wheels of the preferred embodiment shown in FIG. 1 of the manufacturing process for a duckbill mask according to the present invention.

A double slow-release wheel machining process is as follows: when the first slow release wheel 23 or the second slow release wheel 24 rotates, the left friction wheel 94 is driven by the slow release wheel shaft 91 to rotate, in such a condition, the right friction wheel 95 is fixed, in addition, the compression spring 96 is compressed by the compression nut 97, then the compression spring 96 generates pre-tightening pressure, the pre-tightening pressure is transmitted to the right friction wheel 95, and then pre-friction force of the two friction wheels is formed. When the left friction wheel 94 rotates, the pre-friction force generates resistance to reduce a speed of the left friction wheel 94, and meanwhile, a speed of the first slow release wheel 23 or the second slow release wheel 24 is reduced during rotation. When the speed of the first slow release wheel 23 or the second slow release wheel 24 needs to be reduced during rotation, the compression spring 96 may be further compressed, so as to increase the pre-tightening pressure; and when the speed of the first slow release wheel 23 or the second slow release wheel 24 needs to be increased during rotation, the pressure on the compression spring 96 may be released, so as to reduce the pre-tightening pressure, and therefore, the purpose of adjusting friction force between the double slow release wheels and a material wheel is achieved.

Figure 3:
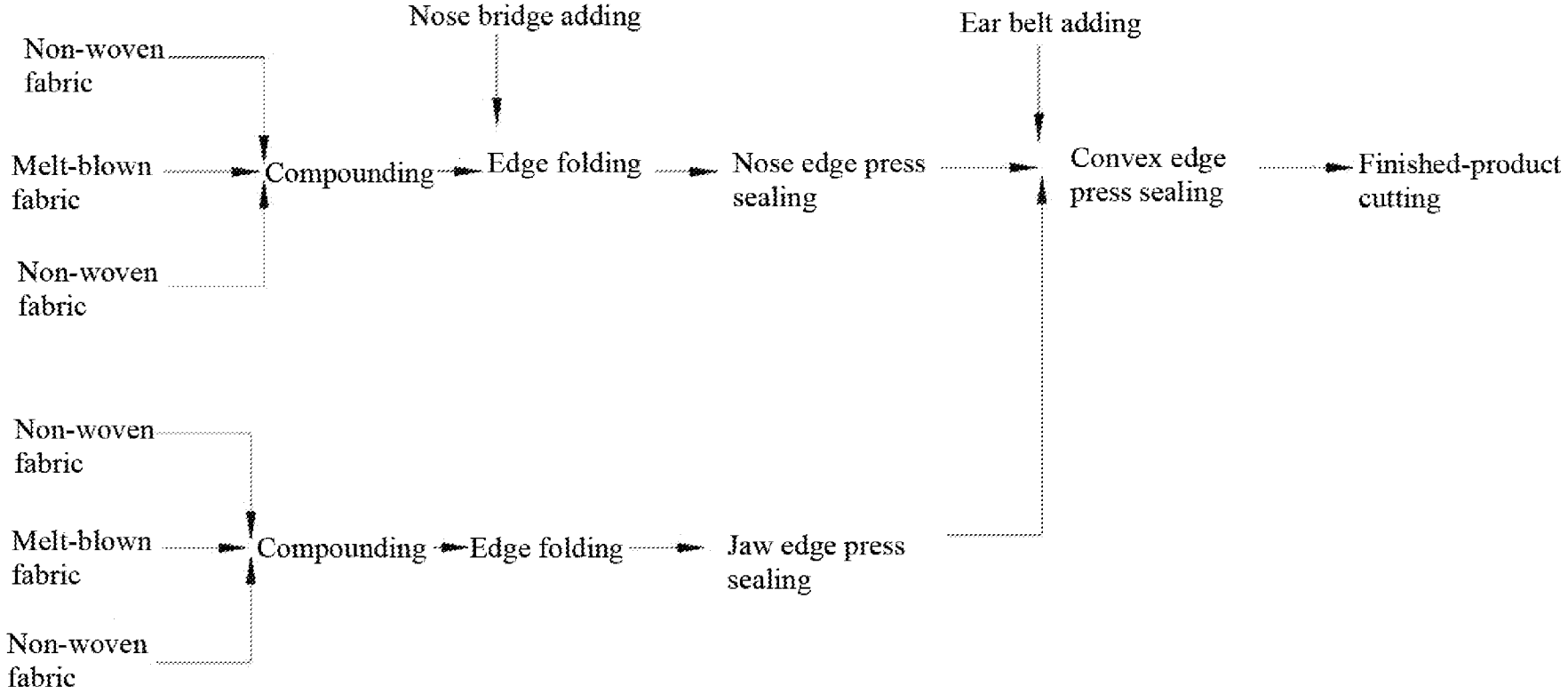
FIG. 3 is a flow chart of a multi-line machining process of a preferred embodiment shown in FIG. 1 of the manufacturing process for a duckbill mask according to the present invention.

Finally, FIG. 3 is a flow chart of a multi-line machining process of a preferred embodiment shown in FIG. 1 of the manufacturing process for a duckbill mask according to the present invention.

The other aspect of the present invention provides a manufacturing process for a duckbill mask. The manufacturing process uses a multi-line machining process, a staggered opposite arrangement method, a double-way staggered cutting process and a double slow-release wheel machining process.

The manufacturing process for a duckbill mask includes a multi-line mask machining apparatus, and includes:

- firstly, sandwich a melt-blown fabric between two layers of non-woven fabrics for compounding, and then respectively perform edge folding and press sealing on an upper nose edge on a mask upper side and a jaw edge on a mask lower side;
- secondly, use a double-way staggered cutting process to add a nose bridge while folding the upper nose edge;
- thirdly, overlap the mask upper side and the mask lower side, then use a staggered opposite arrangement method to perform press sealing on convex edges of the mask upper side and the mask lower side, and use a double-way staggered cutting process to add an ear belt while performing press sealing on the convex edges; and
- fourthly, cut and overlap a finished product, then take the mask upper side and the mask lower side as single masks.

It will be appreciated by those skilled in the art that the process and apparatus for manufacturing a duckbill mask in the present invention include any combination of the parts of this specification. Due to limited length and in order to simplify the specification, these combinations are not described in detail here, but the scope of the present invention consisting of any combination of parts of this specification has been self-evident after people view this specification.

What is claimed is:

1. A manufacturing apparatus for a duckbill mask, comprising a compounding mechanism, an edge folding mechanism, an edge sealing mechanism, a convex sealing mechanism and a cutting mechanism, wherein the compounding mechanism, the edge folding mechanism and the edge sealing mechanism are multi-line mechanisms; and the edge sealing mechanism comprises a nose edge press sealing mechanism and a jaw edge press sealing mechanism, wherein the edge folding mechanism comprises a left mask nose bridge strip, a right mask nose bridge strip, a nose bridge cutter roller, a nose bridge chisel roller, a nose bridge left cutter wheel, a nose bridge right cutter wheel, a left mask nose bridge, a right mask nose bridge, a mask lower-side right edge folding component and a mask lower-side left edge folding component.

2. The manufacturing apparatus according to claim 1, wherein the compounding mechanism comprises a mask upper-side compounding component and a mask lower-side compounding component, wherein the mask upper-side compounding component is provided with a mask upper-side outer non-woven fabric roll, a mask upper-side melt-blown fabric roll, a mask upper-side inner non-woven fabric roll and a mask upper-side compounding wheel; and the mask lower-side compounding component is provided with a mask lower-side outer non-woven fabric roll, a mask lower-side melt-blown fabric roll, a mask lower-side inner non-woven fabric roll and a mask lower-side compounding wheel.

3. The manufacturing apparatus according to claim 1, wherein the nose bridge left cutter wheel and the nose bridge right cutter wheel are arranged at two ends of the nose bridge cutter roller separately.

4. The manufacturing apparatus according to claim 1, wherein an outer surface of the nose bridge left cutter wheel is provided with a nose bridge left front cutter and a nose bridge left rear cutter; and an outer surface of the nose bridge right cutter wheel is provided with a nose bridge right front cutter and a nose bridge right rear cutter.

5. The manufacturing apparatus according to claim 4, wherein the nose bridge left front cutter, the nose bridge left rear cutter, the nose bridge right front cutter and the nose bridge right rear cutter bisect a circumference.

6. The manufacturing apparatus according to claim 1, wherein the edge sealing mechanism comprises a mask upper edge sealing component and a mask lower edge sealing component, wherein the mask upper edge sealing component comprises a mask upper-side guide wheel, a mask upper-side edge sealing upper roller, a mask upper-side edge sealing lower roller and a nose bridge press sealing edge; and the mask lower edge sealing component comprises a mask lower-side edge sealing upper roller, a mask lower-side edge sealing lower roller, a jaw press sealing edge and a mask lower-side guide wheel.

7. The manufacturing apparatus according to claim 6, wherein a mask upper-side left edge sealing member and a mask upper-side right edge sealing member are arranged at two ends of the mask upper-side edge sealing upper roller separately, wherein a left mask nose bridge position is arranged on the mask upper-side left edge sealing member, a right mask nose bridge position is arranged on the mask upper-side right edge sealing member, and the left mask nose bridge position and the right mask nose bridge position are staggered.

8. The manufacturing apparatus according to claim 1, wherein the convex sealing mechanism is provided with a first right mask ear belt roll, a first left mask ear belt roll, a front slow release wheel, a rear slow release wheel, a right ear belt cutter wheel, a left ear belt cutter wheel, an ear belt chisel, a second right mask ear belt roll, a second left mask ear belt roll, an upper overlapping roller, a lower overlapping roller, a convex-edge press sealing upper roller and a convex-edge press sealing lower roller.

9. The manufacturing apparatus according to claim 8, wherein the first right mask ear belt roll and the first left mask ear belt roll are mounted on the front slow release wheel and the rear slow release wheel.

10. The manufacturing apparatus according to claim 1, wherein the cutting mechanism comprises a finished product cutting chisel and an upper cutting roller.

11. The manufacturing apparatus according to claim 1, wherein the manufacturing apparatus is further provided with a double slow-release wheel pressing mechanism, wherein the double slow-release wheel pressing mechanism comprises:

a first slow release wheel or a second slow release wheel, wherein the first slow release wheel or the second slow release wheel is fixedly connected to a first end of a slow release wheel shaft, and a left friction wheel, wherein the left friction wheel is integrally connected to a second end of the slow release wheel shaft; and an end of the left friction wheel matches a right friction wheel fixed on a fixing shaft, and the right friction wheel slides along an axis of the fixing shaft.

12. The manufacturing apparatus according to claim 9, wherein a right support bearing and a left support bearing are arranged on two sides of a connection of the first slow release wheel or the second slow release wheel to the slow release wheel shaft.

13. The manufacturing apparatus according to claim 11, wherein the right friction wheel makes close contact with a first end of a compression spring a second end of the compression spring abuts against a compression nut, and the compression nut is connected to a threaded end of the fixing shaft; and when the first slow release wheel or the second slow release wheel rotates, the left friction wheel is driven by the slow release wheel shaft to rotate.

14. A manufacturing process for a duckbill mask, using a multi-line machining process, a staggered opposite arrangement method, a double-way staggered cutting process and a double slow-release wheel machining process, wherein the manufacturing process comprises:

using a multi-line mask machining apparatus, and comprising the following steps:

firstly, sandwiching a melt-blown fabric between two layers of non-woven fabrics for compounding, and then respectively performing edge folding and press sealing on an upper nose edge on a mask upper side and a jaw edge on a mask lower side;

secondly, using the double-way staggered cutting process to add a nose bridge while folding the upper nose edge;

thirdly, overlapping the mask upper side and the mask lower side, then using the staggered opposite arrangement method to perform press sealing on convex edges of the mask upper side and the mask lower side, and using the double-way staggered cutting process to add an ear belt while performing press sealing on the convex edges; and fourthly, cutting and overlapping a finished product, then taking the mask upper side and the mask lower side as single masks.

15. The manufacturing apparatus according to claim 3, wherein an outer surface of the nose bridge left cutter wheel is provided with a nose bridge left front cutter and a nose bridge left rear cutter; and an outer surface of the nose bridge right cutter wheel is provided with a nose bridge right front cutter and a nose bridge right rear cutter.

* * * * *